US006402309B1

(12) United States Patent
Litman

(10) Patent No.: US 6,402,309 B1
(45) Date of Patent: Jun. 11, 2002

(54) MAGNETICALLY ACTIVATED VALVE FOR INK

(75) Inventor: Stan Litman, Willis, TX (US)

(73) Assignee: Inkjet, Inc., Willis, TX (US)

( * ) Notice: Subject to any disclaimer, the term of this patent is extended or adjusted under 35 U.S.C. 154(b) by 0 days.

(21) Appl. No.: 09/799,290

(22) Filed: Mar. 5, 2001

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS 4,392,168 A * 7/1983 Maruyama et al. ..... 360/129
5,343,226 A 8/1994 Niedermeyeyr et al. ..... 347/85
5,903,293 A * 5/1999 Nikkels et al. ..... 347/86

FOREIGN PATENT DOCUMENTS

JP 62-280042 * 12/1987 ..... 347/91

* cited by examiner

*Primary Examiner*—Anh T. N. Vo
(74) *Attorney, Agent, or Firm*—Fulbright & Jaworski L.L.P.

(57) ABSTRACT

A magnetic sealing cap for dispensing inkjet ink from a bottle into a receptacle. The cap may include two magnetic sealing plates. The cap may also include a ball and ring having a magnetic attraction to each other. The magnetic seal of the invention is reversibly broken by a displacement pin exhibited by the receptacle.

3 Claims, 8 Drawing Sheets

MAGNETICALLY ACTIVATED VALVE FOR INK

FIELD OF THE INVENTION

The invention relates to the field of inkjet ink receptacles.

BACKGROUND OF THE INVENTION

Inkjet ink is used often in assembly lines to label products such as packages and magazines. Maintenance of such inkjet printers and replenishment of their ink supply must be done quickly and efficiently so as to minimize adverse affects on progress of the assembly line. Further, handling of inkjet ink is particularly dangerous, since such ink may be toxic and highly staining in the event of spills.

Ink for assembly line inkjet printers is often delivered by re-usable ink bottles which feed into inkjet ink receptacles, from which ink is drawn for printing. An example of such an application is illustrated in U.S. Pat. No. 5,343,226, the disclosure of which is incorporated herein by reference. In such an application, it is common to insert the inkjet ink bottle, cap down, into the receptacle. So that the cap need not be removed from the bottle to allow the ink to flow, the receptacle passageway may exhibit a pin which, upon insertion of the cap into the receptacle, depresses a spring-loaded plunger in the cap. The displacement of the plunger unseals a passageway in the cap, allowing the inkjet ink to flow downward from the bottle, through the cap and into the receptacle, from where the inkjet printer may draw the ink. Upon removal of the inkjet ink bottle and cap from the receptacle, the spring-loaded plunger reseals the cap, preventing the ink from flowing out of the bottle.

A problem with the spring-loaded plunger caps of the prior art is that springs may break or weaken over time, which is particularly undesirable if the cap is to be re-used many times. The present invention provides an alternative sealing mechanism using magnets.

SUMMARY OF THE INVENTION

There is disclosed herein an inkjet ink bottle cap including a mechanism for locking the cap in a receptacle, a passageway for receiving a displacement pin upon inserting the cap in a receptacle, and a displaceable magnetic seal. The magnetic seal may comprise a ball and sealing seat having a magnetic attraction to each other, and the ball may be displaced by the displacement pin. The magnetic seal may further comprise two sealable seal plates having a magnetic attraction to each other and one of the two plates fixed to a plunger. The plates may be displaced from each by displacement of the plunger by the pin upon insertion of the cap into the passageway. In any embodiment, the magnetic seal re-seals by magnetic attraction upon removal of the cap from the passageway and, thus, removal of the displacement pin from the cap.

DETAILED DESCRIPTION OF THE PREFERRED EMBODIMENT

Figure 1:
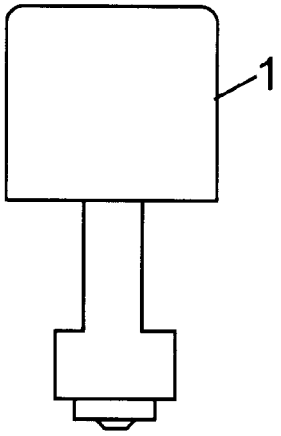
FIG. 1 is a side view of a cap in accordance with the present invention.
Figure 2:
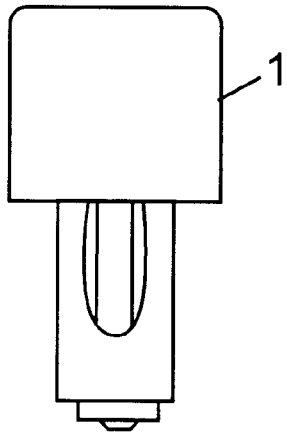
FIG. 2 is a side view of the cap of FIG. 1, turned 90° from the view of FIG. 1.
Figure 3:
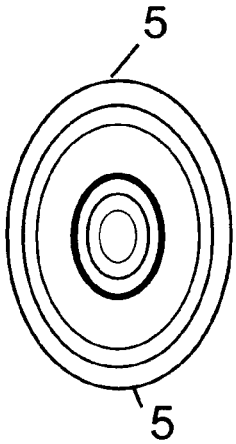
FIG. 3 is a bottom view of the cap of FIG. 1.
Figure 4:
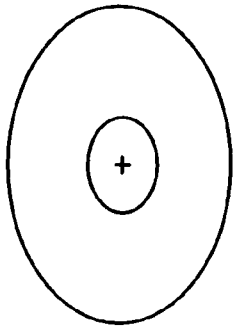
FIG. 4 is a top view of the cap of FIG. 1.

An embodiment of the present invention is illustrated in FIGS. 1–9. Cap 1 has interior threads 3 for affixing the cap 1 to a bottle (not shown). The exterior of the cap 1 exhibits shoulders 5. Cap 1 may be inserted into a low-tolerance opening and sealed with an o-ring (not shown). Cap 1 exhibits a passageway 7 for receiving a displacement pin (not shown) from the receptacle (not shown). The passageway 7 is sealed by a rubber grommet head 9 of the plunger 11. Plunger guides 13 and 14 and o-ring 16 stabilize the rubber grommet head 9 and effect sealing when the rubber grommet head 9 is in the sealed position illustrated in FIGS. 6 and 7. The plunger 11 is further stabilized by a plunger sleeve 15.

The plunger 11 is fixed to a first magnetic plate 17. In the sealed position illustrated in FIGS. 6 and 7, the magnetic attraction between the first magnetic plate 17 and a second magnet plate 19, fixed to plunger guide 13, biases the grommet head 9 of plunger 11 against the interior surface of the passageway 7, sealing the cap 1.

Figure 5:
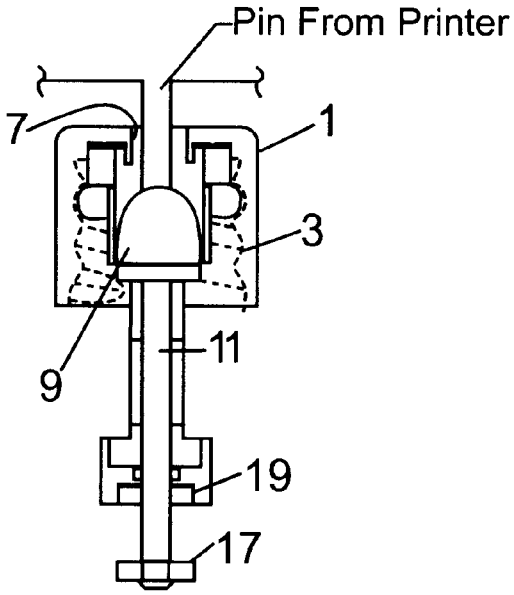
FIG. 5 is a cross-sectional view of the cap of FIG. 1, exhibiting an open seal.
Figure 6:
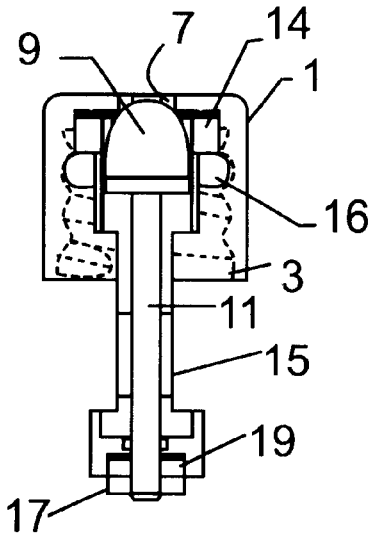
FIG. 6 is a cross-sectional view of the cap of FIG. 2, exhibiting a closed seal.
Figure 7:
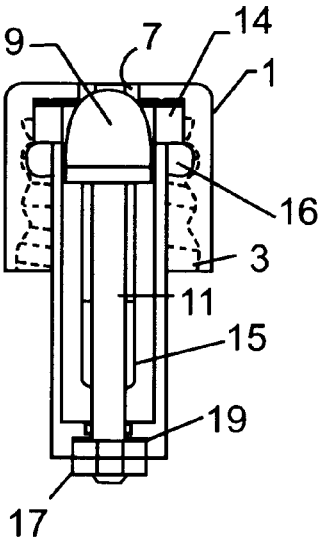
FIG. 7 is a cross-sectional view of FIG. 5, turned 90°.
Figure 8:
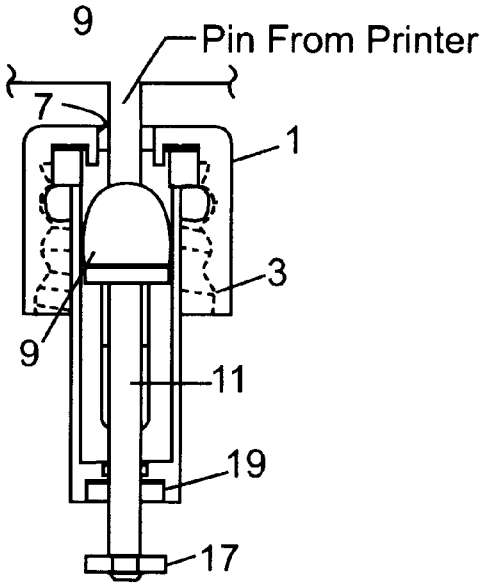
FIG. 8 is a cross-sectional view of FIG. 6, turned 90°.
Figure 9:
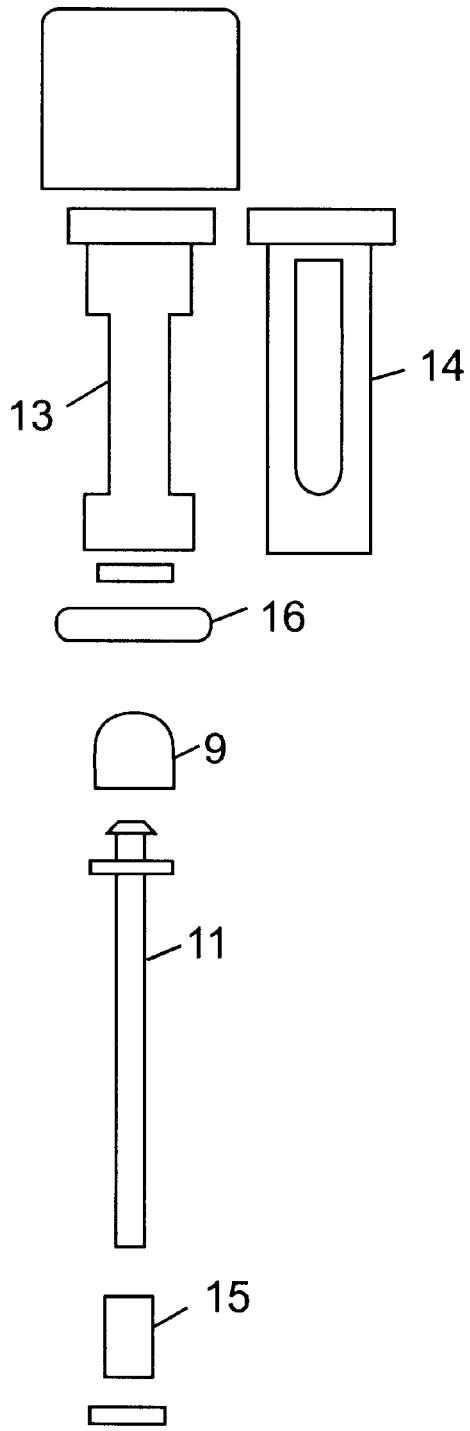
FIG. 9 is an exploded view of the cap of FIG. 1.
Figure 10:
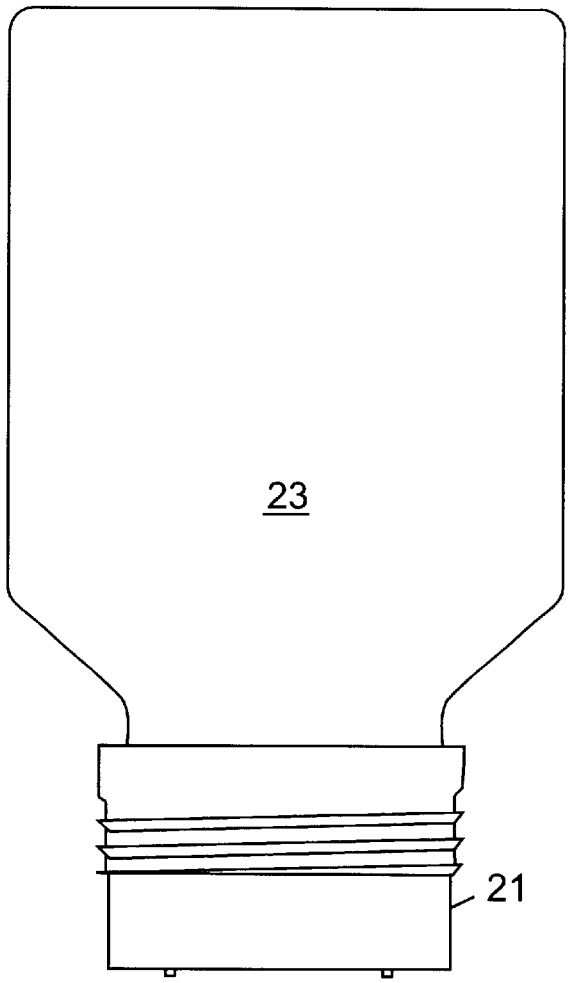
FIG. 10 is a side view of an inkjet ink bottle including an alternative embodiment of a cap in accordance with the present invention.
Figure 11:
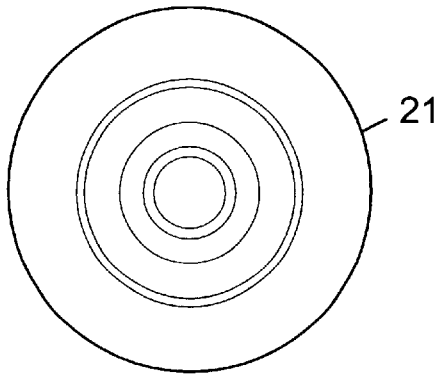
FIG. 11 is a top view of the cap of FIG. 10.

In the unsealed position illustrated in FIGS. 5 and 8, a displacement pin (not shown) from a receptacle presses the rubber grommet head 9 of the plunger 1 away from the interior surface of the passageway 7, causing the plates 17 and 19 to separate and opening the cap 1 to allow ink to flow through the passageway 7. Upon removal of cap 1 from the receptacle, and hence removal of the pin (not shown) from the passageway 7, the magnetic attraction between plates 17 and 19 causes the plates to be drawn together as shown in FIGS. 6 and 7, resealing the passageway 7.

An alternative embodiment of the present invention is illustrated in FIGS. 10–14. Cap 21, illustrated attached to bottle 23, exhibits exterior threads 25 for inserting the cap 21 and bottle 23 into a receptacle (not shown) by screwing the cap 21 into receiving threads of a receptacle (not shown).

Cap 21 includes a ball cage 27, a steel ball 29, first o-ring 31, second o-ring 33, plug 35, flat washer magnet 37, and passageway 39. In the sealed position illustrated in FIG. 13, magnetic attraction between steel ball 29 and flat washer magnet 37 biases steel ball 29 against o-ring 33, sealing passageway 39.

Figure 12:
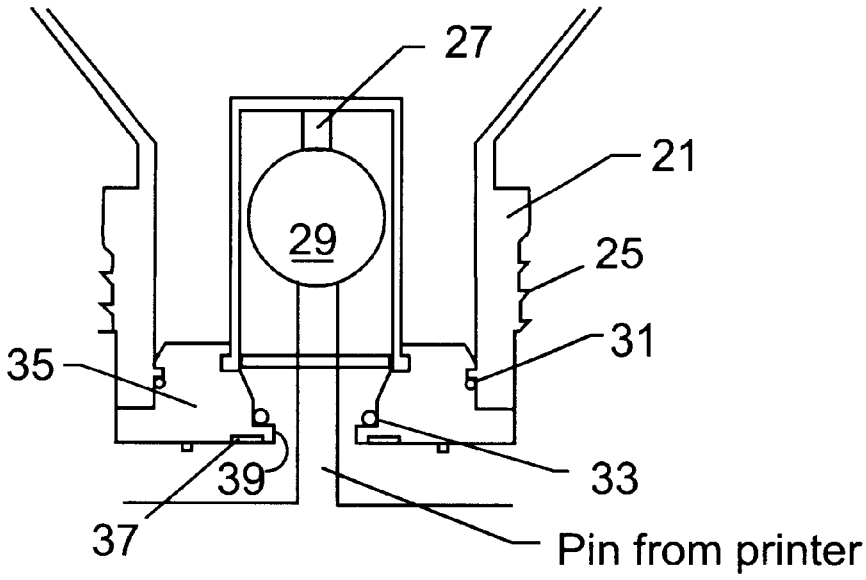
FIG. 12 is a cross-sectional view of the cap of FIG. 10, exhibiting an open seal.
Figure 13:
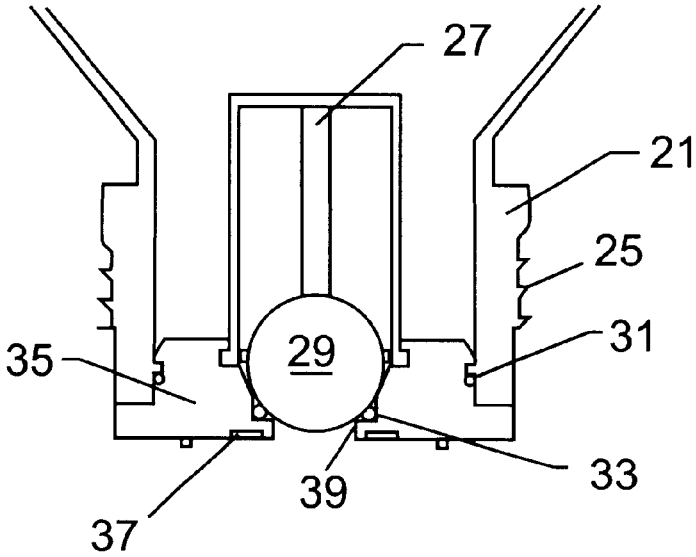
FIG. 13 is a cross-sectional view of the cap of FIG. 10, exhibiting a closed seal.
Figure 14:
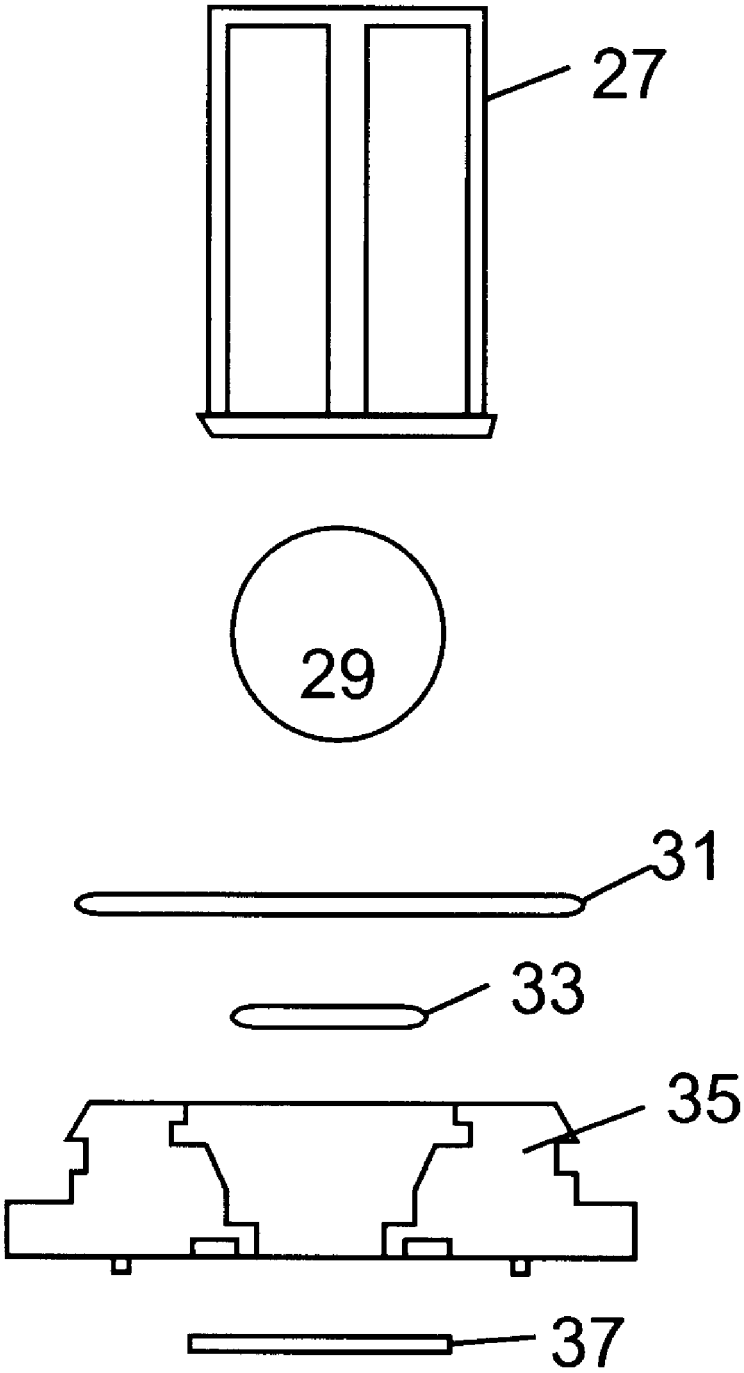
FIG. 14 is an exploded view of the cap of FIG. 10.
Figure 15:
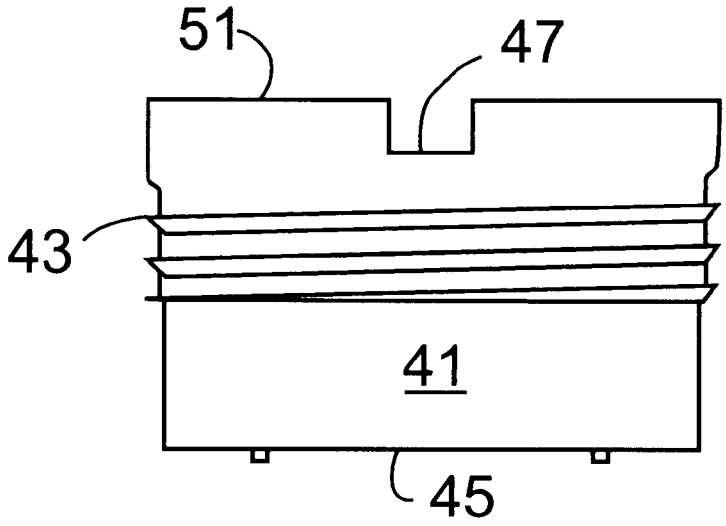
FIG. 15 is a side view of an adapter.
Figure 16:
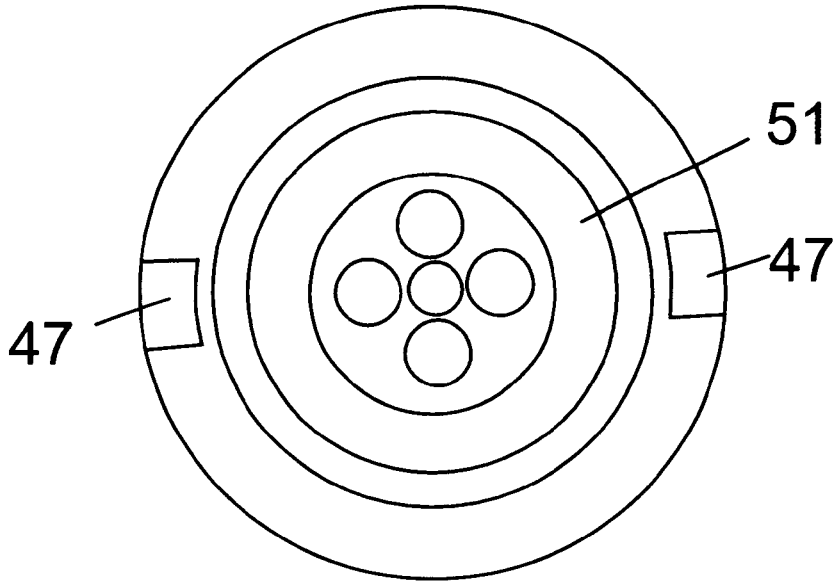
FIG. 16 is a top view of the adapter of FIG. 15.

In the unsealed position illustrated in FIG. 12, a displacement pin (not shown) from a receptacle (not shown) presses the steel ball 29 into the ball cage 27 and away from o-ring 33 and flat washer magnet 37, opening passageway 39 to allow ink to flow through the cap 21 into a receptacle (not shown). Upon removal of cap 21 from the receptacle, and hence removal of the pin (not shown) from passageway 37, the magnetic attraction between the steel ball 29 and flat washer 37 causes the steel ball 29 to again bias against o-ring 33, resealing the passageway 39, as illustrated in FIG. 13.

Figure 17:
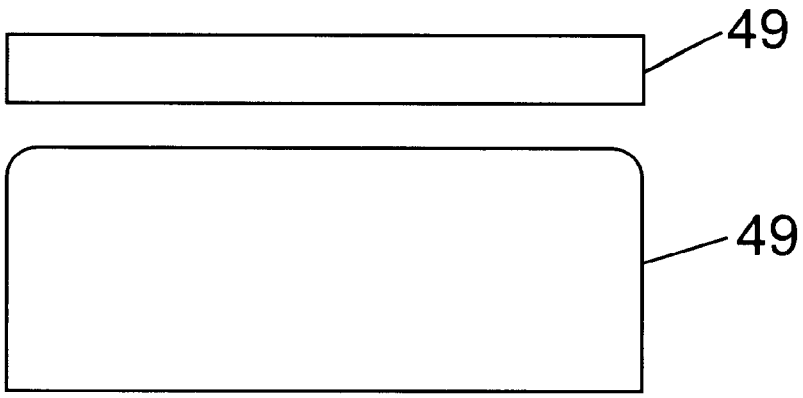
FIG. 17 is a top and side view of a key.
Figure 18:
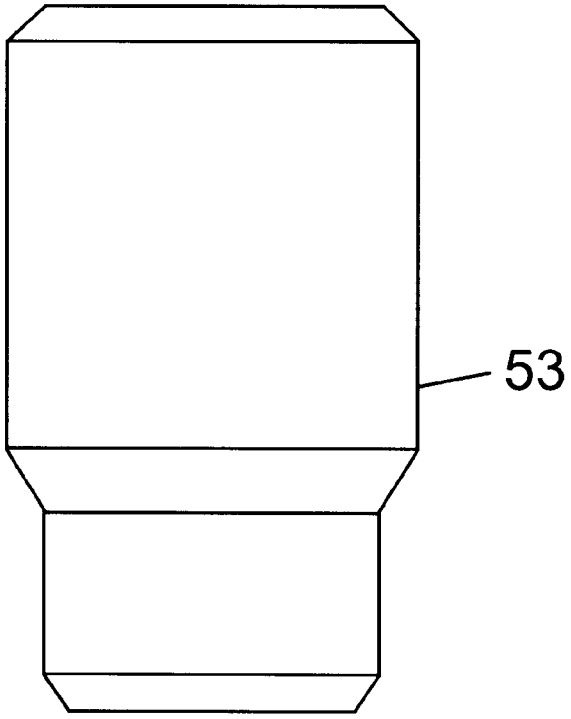
FIG. 18 is a side view of a plug for use with the adapter of FIG. 15.

The cap of the present invention may be applied to existing inkjet ink receptacle by using an adapter, if necessary. FIGS. 15–18 illustrate a suitable adapter. Adapter 41 exhibits threads 43 to engage an inkjet ink receptacle (not shown) designed to receive a threaded inkjet ink bottle cap (not shown) at top 45. Portion 45 of adapter 41 screws into an inkjet ink receptacle (not shown) using key receiver 47 and key 49. FIG. 17 exhibits both top and longitudinal side views of key 49. The non-threaded inkjet ink bottle cap seals with adapter 41 with an o-ring in upper portion 51. Upper portion 51 of adapter 41 receives a non-threaded bottle cap (not shown). Upper portion 51 may be sealed without a bottle cap using plug 53.

One of ordinary skill in the art, with the benefit of this disclosure, will recognize that many other embodiments of the invention are possible within the scope of the claims. Any two magnetically attracted contact points, which are displaced from each other upon insertion of a inkjet ink cap into a receptacle, and which displacement is reversed upon removal, may be suitable. A "receptacle" may be any receiver for inkjet ink for which the cap of the present invention is useful.

What is claimed is:

1. An ink bottle cap comprising:

a seal mechanism for sealing the cap in a receptacle;

a passageway in the cap for receiving a displacement pin upon inserting the cap in the receptacle; and a displacement magnetic seal, the seal becoming displaced upon inserting the cap in the receptacle.

2. The apparatus of claim 1 in which the magnetic seal further comprises a ball and a sealing seat, the ball and the seat having a magnetic attraction to each other, and the ball being displaced from the seat by the displacement pin upon inserting the cap in a receptacle.

3. The apparatus of claim 1 in which the magnetic seal further comprises two sealable seal plates having a magnetic attraction to each other, and a plunger fixed to one of the seal plates, the plates being displaced from each other by the displacement pin displacing the plunger upon inserting the cap in the receptacle.

* * * * *

UNITED STATES PATENT AND TRADEMARK OFFICE

CERTIFICATE OF CORRECTION

PATENT NO. : 6,402,309 B1
DATED : June 11, 2002
INVENTOR(S) : Stan Litman

It is certified that error appears in the above-identified patent and that said Letters Patent is hereby corrected as shown below:

Column 2,
Line 45, change "PLUNGER 1" to -- PLUNGER 11 --.

Signed and Sealed this

Eighth Day of October, 2002

*Attest:*

*Attesting Officer*

JAMES E. ROGAN
*Director of the United States Patent and Trademark Office*